US005176599A

United States Patent [19]

Beliakov

[11] Patent Number: 5,176,599

[45] Date of Patent: Jan. 5, 1993

[54] EXERCISING APPARATUS FOR DEVELOPING MAXIMUM FORCE ARM OR LEG BLOWS

[76] Inventor: Evgeni Beliakov, 832 Easley St., Silver Spring, Md. 20910

[21] Appl. No.: 774,350

[22] Filed: Oct. 10, 1991

[51] Int. Cl.[5] ..... A63B 21/02

[52] U.S. Cl. ..... 482/91; 482/92; 482/148; 482/903

[58] Field of Search ..... 482/20, 116, 22, 121, 482/123, 14, 99, 1, 20, 135, 91, 903, 92, 148, 903, 114, 73 J, 4, 5, 6; 273/193 R, 193 A, 200 R, 200 A, 200 B, 73 R, 194 R, 26 E, 26 EA, 26 R, 25; 248/206.5, 205.5

[56] References Cited

U.S. PATENT DOCUMENTS

| | | | |
|---|---|---|---|
| 518,967 | 5/1894 | Poole | 482/116 |
| 913,799 | 9/1909 | Zund-Burguet | 482/116 |
| 3,861,215 | 1/1975 | Bradley | 482/116 |
| 3,862,756 | 1/1975 | Selliken | 273/23 |
| 4,243,219 | 1/1981 | Price | 273/26 B |
| 4,974,836 | 12/1990 | Hirsch | 273/26 R |
| 5,014,981 | 5/1991 | Prelich | 482/903 |

*Primary Examiner*—Richard J. Apley
*Assistant Examiner*—Jerome Donnelly
*Attorney, Agent, or Firm*—Laurence R. Brown

[57] ABSTRACT

Muscular development of an athlete is achieved for increasing the starting acceleration and stroke speed when an athlete initiates a movement stroke such as a punch from a boxer's arm, throwing a baseball pitch or kicking a football, etc. by the means and method of this invention. Thus, the initial movement of the athlete is restrained with an external force of predetermined magnitude which is released in response to the athlete's movement overcoming the restraining force. Thus, those muscles are developed which are used in initiating motion so that they deliver greater initial acceleration to attain higher stroking speed which is converted to an impact blow of greater force. An exercise machine for such muscular training provides the initial but releasable restraining force by means of two separable magnetically attracted members having the predetermined initial force adjustably varied by introducing a variable air gap distance between the magnetically attracted members. The machine is flexibly mounted on an anchored base to permit movement of the athlete in a three dimensional stroke pattern. A cord wound on a bobbin and affixed to the athlete is released from a locked bobbin position to permit substantially unrestricted movement after the initial force threshold is overcome.

9 Claims, 3 Drawing Sheets

EXERCISING APPARATUS FOR DEVELOPING MAXIMUM FORCE ARM OR LEG BLOWS

TECHNICAL FIELD

This invention relates to exercising methods and apparatus and more particularly it relates to and muscular development for specific body movement patterns.

BACKGROUND ART

There are many exercising methods and machines in the art for developing muscular performance by dynamic loading of body parts in particular patterns over a movement cycle or exercise stroke, such as punching bags, bench presses, bicycles, rowing machines, and programmed exercise devices typified by such U.S. patents as E. R. Flavell, et al. 4,184,678, Jan 22, 1980; R. F. Bradley, 4,138,106, Feb 6, 1979; S. Owens, 4,934,692, Jun 19, 1990; and J. W. Brooker, 4,609,189, Sep. 2, 1986. However, these devices all have as a goal the development of muscular performance over a sustained movement stroke or cycle.

DISCLOSURE OF THE INVENTION

Now in accordance with this invention, muscle development is achieved in a novel way for achieving fast starting speeds, which in turn permits more powerful blows, such as ideal in boxing, golf, soccer, for example. Similarly in tennis, hockey, baseball, football, and basketball, etc., starting speeds and hitting power can be significantly improved by the methods and apparatus afforded by this invention. Thus, muscles are trained for fast starts with high acceleration thereby to result in high motion speeds with corresponding high inertia, which can thus be dissipated in the form of more powerful impact blows. Thus, the invention can produce a boxer's arms capable of higher acceleration with corresponding higher speed, capable of delivering more powerful blows. In a similar manner, a tennis player can attain more powerful serves or a baseball player can improve pitching or batted ball speeds, a football or soccer kicker can have leg muscles trained to kick the ball further at higher speeds, etc.

Accordingly, those special muscles, generally arm or leg muscles, which are used in the initiation of a movement, are trained and developed to initiate movement strokes at higher speed. In turn, the higher movement speed produces movement inertia which may be spent upon delivery of more powerful impact blows that are indicative of greater athletic ability.

Exercising methods and apparatus are thus provided which incorporate the principles that athletic ability can be improved by muscular development for maximizing the capabilities of those muscles (and in particular arm and leg muscles) which are specifically used to initiate and accelerate a movement stroke, and that higher movement speeds initiated abruptly with higher acceleration can be achieved by muscular training exercises so that greater inertial force is available for delivering more forceful impact blows to another body such as a boxer or a ball.

Thus, consider that a trainer can hold back a boxer's starting stroke by holding a hand on the glove with a predetermined force to retard initiation of a stroke. The boxer and trainer in this manner can tone muscular development for overcoming greater and greater restraining forces to initiate a boxing stroke. The trainer then relaxes the restraining force as soon as motion is initiated, so that the muscular force is converted into high acceleration motion of the arm over a short stroke initiating time period resulting in attaining a high speed stroke with enough movement inertia to deliver a higher force blow upon impact.

The trainer in turn can be replaced by a self-actuated exercising machine. In a preferred embodiment, a cord wound on a bobbin may be affixed to an arm or leg collar, where initiation of bobbin rotation is restrained by an adjustable magnetic attraction force, which when broken permits the cord to be freely spent from the bobbin. The bobbin is preferably flexibly mounted to permit the movement of the arm or leg over a three dimensional path during a movement stroke to thereby develop a natural delivery path for a blow to a karate opponent or a ball, for example.

Further objects, features and advantages of the invention will be found throughout the following description and annexed drawings, wherein like reference characters identify similar features in the various views.

THE PREFERRED EMBODIMENT

Figure 1:
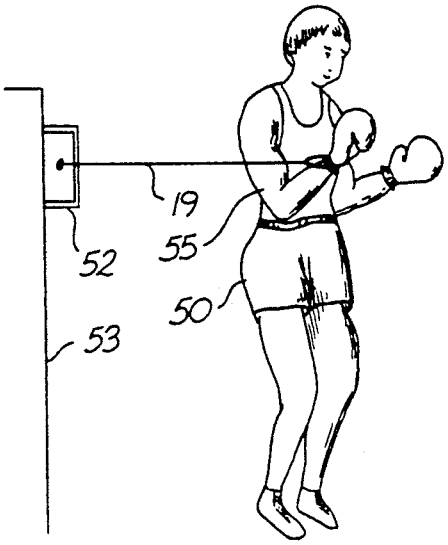
FIG. 1 is a sketch of a boxer in a position to initiate a powerful punching stroke.
Figure 2:
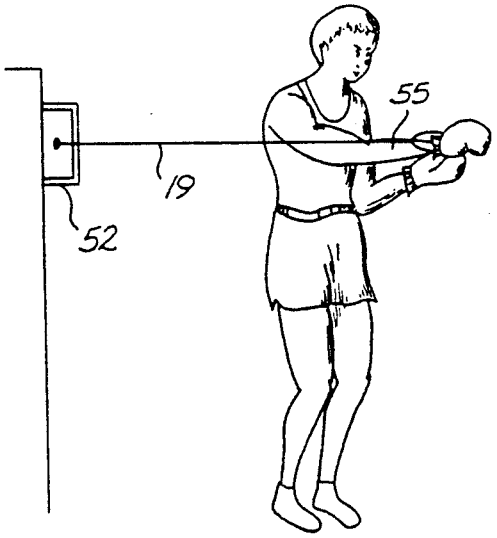
FIG. 2 is a sketch of a boxer near the end of the delivery range of a punching stroke.

Now with reference to the drawing, it is seen from FIGS. 1 and 2 that the boxer 50, has a cord 19, and body wrist band 51, attached to and between his right arm 55 and the exercise machine 52, anchored to a wall 53, or the like, so that the cord can move with the arm from the boxing stance ready-to-punch position of FIG. 1 through the punch stroke of FIG. 2.

In accordance with this invention, the exercise machine 52 restrains movement of the athlete's arm 55 from its starting posture in FIG. 1 until the athlete exerts a force overcoming a predetermined external threshold force exerted by machine 52. Thereafter the restraining force is removed so that the arm 55 freely moves in a normal punching stroke into the position of FIG. 2 as cord 16 is paid out. Thus, the boxer's muscles that initiate the stroke are developed so that the initial acceleration is increased as well as the punch stroke speed. Because of the inertia in motion, the higher stroke speed then delivers a blow of increased force upon impulse impact with a boxer contestant.

The same machine and muscle development method is similarly applicable to other sports in which speed, impact force and high starting acceleration are important, including but not limited to fencing, soccer or football kicking, golf strokes, baseball pitching and batting, hockey, and the like. In accordance with the training method provided by this invention, the machine 52 can take various configurations and could be replaced by a trainer exerting the initial restraining force and subsequent release manually.

Figure 4:
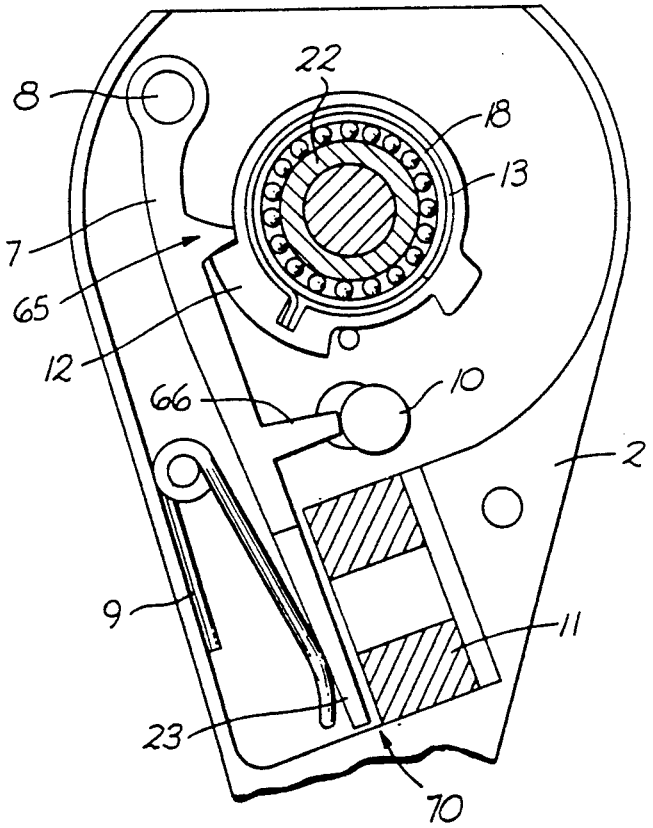
FIGS. 4 and 5 are respectively partial front and back views, partly in section, of the exercising machine.
Figure 3:
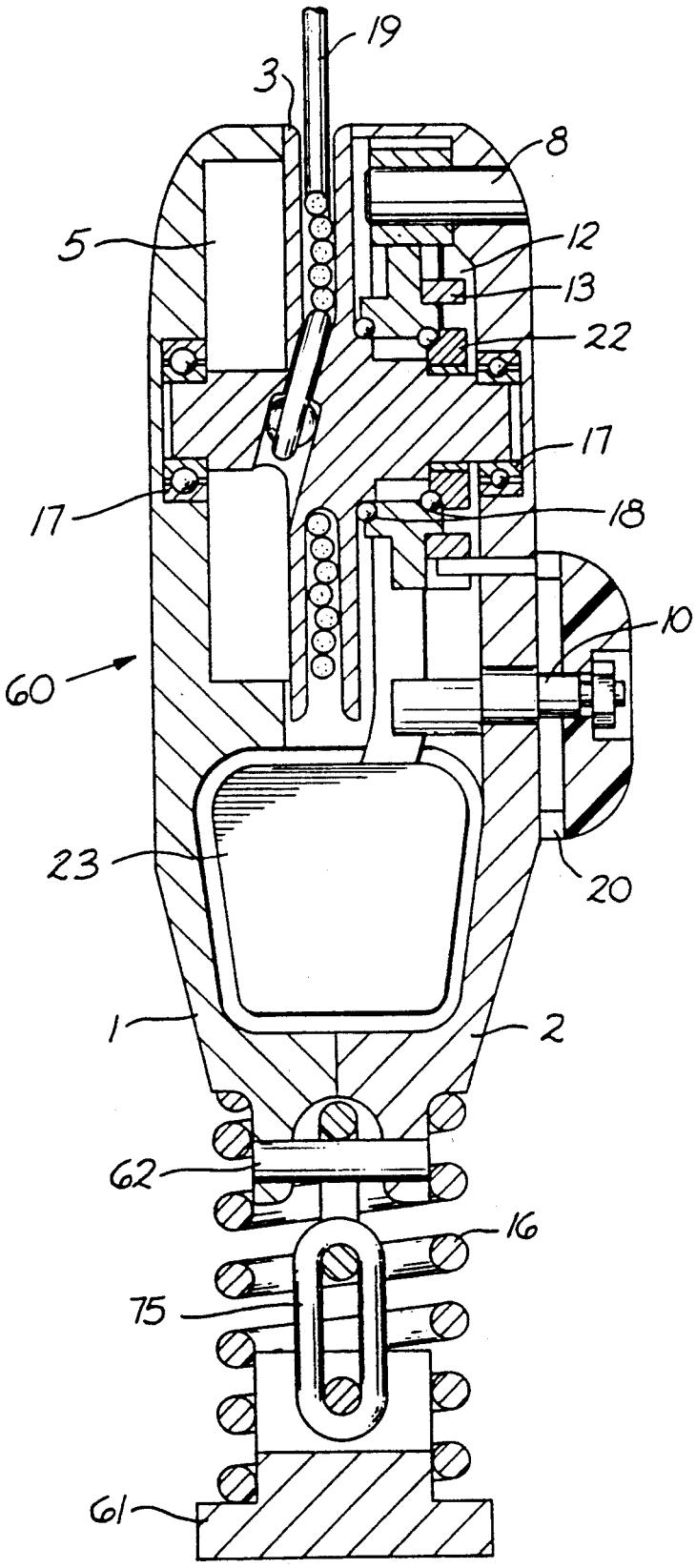
FIG. 3 is a side view, partly in section, of an exercising machine provided in an embodiment of the invention.
Figure 5:
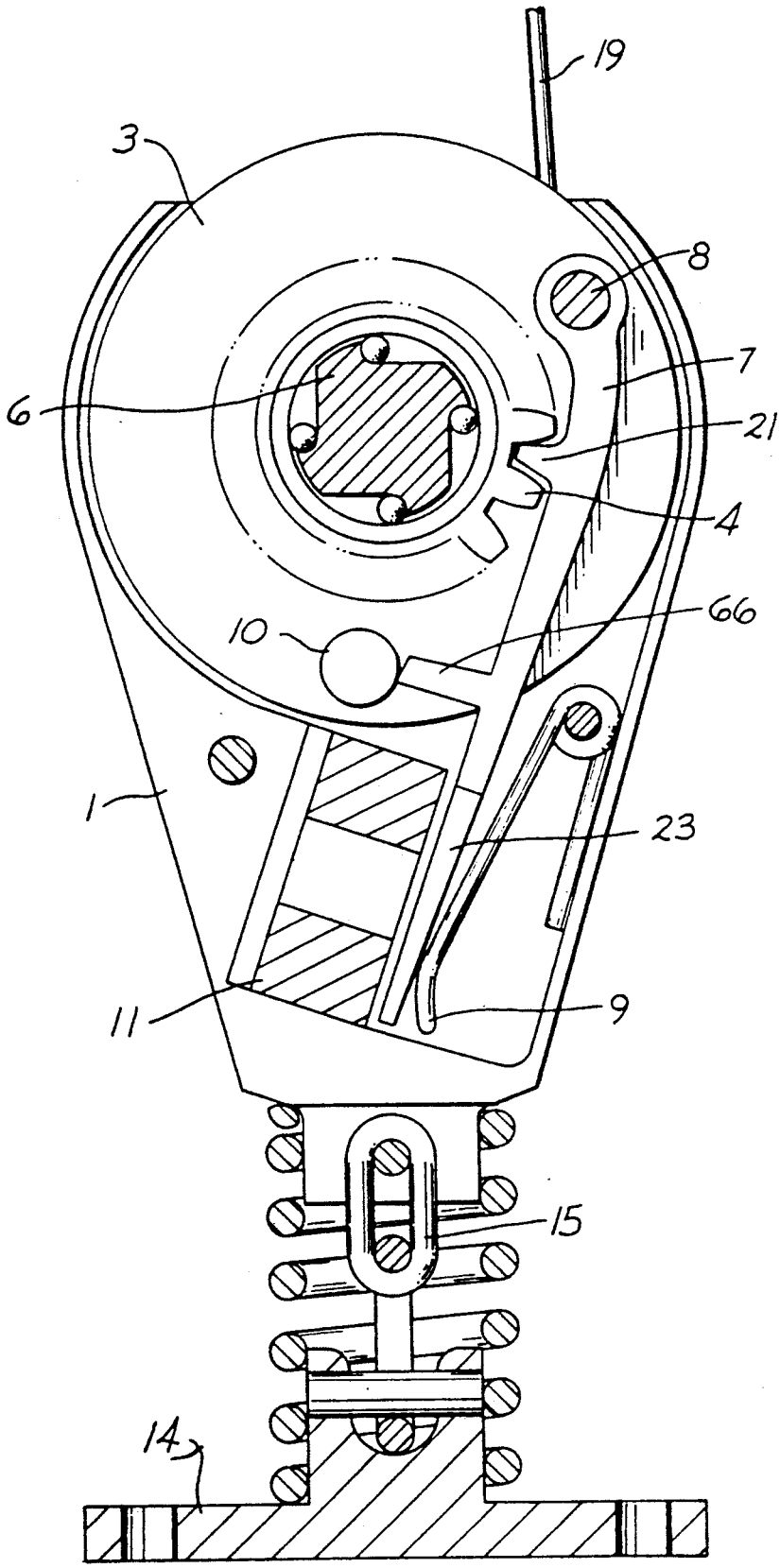

The preferred exercise machine embodiment of FIGS. 3, 4, and 5 and its mode of operation is now addressed. The more comprehensive side view of FIG.

3 shows a main body 60 flexibly mounted by spring 16 on a base 61 which may be fixed in an operating position on a wall or floor surface. Thus, the body 60 may swing with the punch and permit the athlete to move (his arm, leg, etc.) three dimensionally with the cord 19 attached.

The body 60 has two cover pieces 1, 2 held together by band 62 and screws or bolts (not shown). A bobbin 3, rotatable on shaft 63, retains a coiled length of the cord 19 in a normal position of the machine before movement of the cord by the athlete is achieved by overcoming the external restraining force, later described. A spiral spring 5 serves to rewind the cord 19 on the bobbin when the athlete returns to a starting position, and has a bias force that does not significantly restrain the rotation of the bobbin 3 or the free pay out of the cord 19 after the initial restraining force is released, as aided by means of the free-wheeling clutch 6 and the bearings 17, 18.

The restraining means, as better seen from FIGS. 4 and 5 comprises a lever arm assembly 7 pivotably mounted on rod 8 for engagement of tooth 21 into the mating gears on cog wheel 4, which is affixed to bobbin 3 and rotates therewith. The spring 9 returns the locking lever arm means 7 into its normally engaged and locked position following a stroke movement cycle.

The cog gear teeth and tooth 21 are so designed that they tend to cam the lever arm counterclockwise about pivot rod 8 when an unwinding force (tension) is exerted on the cord 19 by an athlete. The cam plate 12 and corresponding cam rider 65 will retain the lever arm 7 in an unlocked position for rotation of bobbin 3 until the return of the extended cord 19 onto bobbin 3, when spring 9 pushes lever 7 clockwise into the locking position.

The counterclockwise force on lever 7 in response to the athlete's body movement attempt must overcome the magnetic field attraction force supplied by permanent magnet 11 and the coacting soft iron magnetic member 23, which serves to provide a predetermined threshold force in restraint against movement of cord 19 by a corresponding movement of the athlete.

This threshold retaining force is variably adjusted by knob 10 and eccentrically mounted cam 10 to move cam rider 66 on the locking lever 7 over a range introducing an air gap 70 of variable thickness between the magnetic members 11 and 23. Thus, with aid of leverage of lever arm 7, a significant range of adjustment of the restraining force opposing the athlete's initial movement is provided. Thus, as the athlete's muscles are developed and toned, the restraining force may be increased to further challenge and train the athlete for producing the greater initial acceleration and movement speeds that improve athletic ability in the particular sport or movements for which the training program is effective.

As seen in FIG. 3, a stiffener joint 75 is provided to restrain the body 60 from movement in the plane of the cord 19, where the critical restraining force must be held without movement of the body 60, and retained cord 19. However, three dimensional movement of the athlete to pull the cord on either side of that plane during the movement stroke is accomplished to prevent any interference with a boxer's punching stroke pattern, etc.

It is therefore evident that this invention has provided novel means and methods which are defined with particularity in the following claims to identify the spirit and nature of the invention.

I claim:

1. An exercising machine for developing explicit muscles of an athlete for improving athletic ability, comprising in combination, force exerting means for restraining muscular movement of the athlete away from a staring posture during a forced exercise stroke by the athlete to produce a predetermined initial threshold external restraining force, force modifying means for removing the restraining force to free the athlete for substantially unrestrained movement away from the starting posture when the athlete overcomes the initial restraining force threshold thereby initiating substantially unimpeded movement away from the starting posture and spring actuated means for automatically reestablishing the initial threshold forces at the completion of said forced exercise stroke by the athlete.

2. The exercising machine of claim 1 further comprising, a body attachment band for positioning about a movable extremity of the athlete, and a cord coupled to and between the body attachment band and the force exerting means.

3. The exercising machine of claim 1 wherein said force exerting means and means for removing the restraining force further comprise two magnetic members, at least one being a magnet, held in an initial position with an air gap therebetween by a strong magnetic attraction field, and the force modifying means responsive to movement of the athlete from said starting posture removes the restraining force by separating the magnetic members to a further position substantially removing the magnetic attraction field between the magnetic members.

4. The exercising machine of claim 3 further comprising adjusting means for varying the predetermined restraining force by variably inserting an air gap of adjustable distance between the two magnetic members.

5. The exercising machine of claim 3 further comprising a cord of predetermined length adapted for movement by said athlete, a bobbin and accompanying mechanism carrying a portion of said length in coiled position in a normal position of the machine before movement of the cord by the athlete, and means responsive to removal of the restraining force by said release means for paying out said cord from the bobbin with movement of the athlete without substantial restraining force.

6. The exercising machine of claim 5 further comprising locking lever means for locking said bobbin nonrotatably and means for unlocking the locking lever means in response to movement of said release means.

7. The exercising means of claim 6 further comprising camming means for retaining the locking lever in unlocked position until the cord is moved by said athlete back into the normal position.

8. The exercising machine of claim 1 further comprising a body containing said machine movable with movements of said athlete, mounting means providing a mounting base and flexible spring means attaching the mounting base to the body to permit three dimensional movements of the body in response to movements of the athlete.

9. The exercising machine of claim 8 further comprising joint means for preventing movement of the flexible spring means in response to movements of the athlete before removal of the restraining force by said release means.

* * * * *